United States Patent [19]

Fulghum

[11] 4,076,958

[45] Feb. 28, 1978

[54] SIGNAL SYNTHESIZER SPECTRUM CONTOUR SCALER

[75] Inventor: Donald P. Fulghum, Dallas, Tex.

[73] Assignee: E-Systems, Inc., Dallas, Tex.

[21] Appl. No.: 722,814

[22] Filed: Sep. 13, 1976

[51] Int. Cl.[2] ..... G10L 1/00

[52] U.S. Cl. ..... 179/1.5 A

[58] Field of Search ..... 179/1.5 A, 1.5 G, 1.5 M, 179/1.5 H

[56] References Cited

U.S. PATENT DOCUMENTS

| | | | |
|---|---|---|---|
| 3,394,228 | 7/1968 | Flanagan | 179/1.5 H |
| 3,697,699 | 10/1972 | Gluth | 179/1.5 A |
| 3,974,334 | 8/1976 | Cockerell | 179/1.5 A |
| 3,982,070 | 9/1976 | Flanagan | 179/1.5 M |

*Primary Examiner*—Kathleen H. Claffy
*Assistant Examiner*—E. S. Kemeny
*Attorney, Agent, or Firm*—Robert V. Wilder

[57] ABSTRACT

A speech signal synthesizer features a time and frequency scaler for improved accuracy of signal synthesis. A digital signal representative of a first analog signal, such as a voice signal, having varying parameters, such as frequenty or amplitude, is converted by a synthesizer into an analog output signal which varies in substantially the same manner as the first signal. The synthesizer receives a transmitted digital signal representing the first analog signal and synthesizes the varying parameters thereof to provide the analog output signal. First, the digital input signal is applied to a serial-to-parallel converter and subsequently input to a modulated frequency generator controlled by the operation of a modulation controller. Digital data processed through the modulated frequency generator is time and frequency scaled, and it is this time and frequency scaling that provides improved accuracy in recreating the proper amplitude relationship of the first analog signal. Following time and frequency scaling, the processed digital data is input to an amplitude accumulator and subsequently converted into the analog output signal in a digital-to-analog converter. Time scaling is implemented by apparatus that utilizes the transmitted digital data information to interpolate between spectrum segments to present a smooth spectrum to the output analog signal. For frequency scaling, the frequency scaler interpolates between harmonic frequencies of the first analog signal in consecutive frames and the processed digital data of the time scaling. Both the time domain scaling and the frequency domain scaling are based on the value of a cosine squared function extending between adjacent data points on adjacent frames.

31 Claims, 14 Drawing Figures

N VALUE (27)
COS² CURVE
NEW INTERMEDIATE VALUE
(X)
Δ
N+1 VALUE (63)
DIFFERENCE OF N & N+1 VALUES
90°
153° φ
180°

0°
30°
90°
N+1= 25
X=13.75
Δ= −11.25
DIFF=−15
N=10
SPECTRUM ENVELOPE
PITCH HARMONICS
116
AMPLITUDE
0 HZ
VOICE
3 KHZ
FREQUENCY
118
AMPLITUDE
CHANNELS: 1 2 3 4 5 6 7 8 9 10 11 12 13 14 15 16
FREQUENCY
TYPICAL SYNTHESIZED VOICE
SPECTRUM CHANNEL BANDWIDTH MARKERS

TSD7+
TSD6+
TSD5+
TSD4+
212
84a
TSD3+
TSD2+
TSD1+
TSD0+
212
86a
84b
86b
244
ADSC−
248
242
246
MCS3+
258
MCS7+
240
260
322
PR13+
PR12+
PR11+
PR10+
92a
PR09+
PR08+
PR07+
PR06+
92b
MCS2+
A0B0A1B1A2B2A3B3
CX
CY
250
S0
S1
CX1
CY1
CX2
CY2
CX3
252
254
256
MAG1+
MAG3+
MAG5+
MAG7+
MAG0+
MAG2+
MAG4+
MAG6+
TO FIG. 12b

MC16⁻
MC$5⁺
ENCN⁺
TPH1⁻
SAMC⁻
TPHO⁻
DOOR⁺
M2SC⁻
276
278
274
290
294
272
270
282
284
280
292
300
298
286
288
302
304
306
106a
106b
CS A0 A1 A2 A3 WE
D2
D1
D0
O0 O1 O2
I HARM.
2or MORE HARM.'S
TO ENABLE
TIME SCALER CONTROL (H=ON)
S1
FROM FIG. 12a
110
112a
112b
308
311
310
312
262
266
264
318
316
314
320
TRIG FUNCTION ENABLE (L=ON)
94a
94b
A0 A1 A2 A3 A4
COS²
H=1→4
H=5→8
HARM.'S PER CHANNEL CONTROL (H=Z ; L=ALL)
OLD SCALER CONTROL (L=ON)
268
0 1 2 3 4 5 6 $
+V

SIGNAL SYNTHESIZER SPECTRUM CONTOUR SCALER

This invention relates to a synthesizer responsive to digitally coded input information for conversion thereof into analog signals and, more particularly, to a synthesizer with time and frequency domain scaling of the received digitally coded input information.

The human speech mechanism produces speech by forcing air from the lungs through the vocal chords in the larynx. The vocal chords are muscles that open and close in vibration, at a pitch frequency, to produce a stream of pulsating air passing out through passages of the throat, nose, mouth and lips. These passages modulate the pulsating air to resonate various pitch harmonics, creating different voice sounds. With the vocal chords relaxed, the air rushes through these passages without pulsing and the tongue, palate and lips produce noiselike unvoiced sounds. Spoken vowels are examples of voice speech, and some consonants are examples of unvoiced sounds.

The frequency spectrum of normal speech contains a great deal of redundant information. During the vowel sounds, a speech spectrum is a set of harmonically related sounds, and the fundamental frequency of the harmonic set is the pitch frequency. Knowing the pitch frequency makes it possible to predict where most of the energy in a voice spectrum will occur inasmuch as this energy occurs at harmonic spacings. The fundamental frequencies of the voice sound lie primarily in a range from about 70 to 350 Hz. The unvoiced sounds have no definite harmonic pattern, but consist essentially of frequencies randomly distributed throughout the audio spectrum, and varying in amplitude in accordance with the sound being reproduced. Thus, a composite of speech includes the pitch frequency, amplitude information relating to bands (or channels) of the voice frequency spectrum, and an indication that unvoiced sounds are present in the amplitude data relating to the voiced sounds.

It is well known that analog speech signals may be converted into a digital signal representation where the digital signal is composed of consecutive frames of words, and one word of each frame is representative of the fundamental frequency associated with the speech sounds at an instant of time, and successive words in the respective frame are representative of the energy associated with at least one of a plurality of successive bands (or channels) of spectrum segments of the voice signal to be reproduced. At the given instant of time, each of the successive bands bears a predetermined frequency relationship to the fundamental frequency and the synthesis of the output signal is produced by generating from the word representative of the fundamental frequency in each respective frame, a field of digital words representative of the frequency and each of its harmonics at each instant of time.

A synthesizer for converting such digitally coded information into an analog signal is described in U.S. Pat. No. 3,697,699. The synthesizer as described in this patent receives serially presented, digitally coded information which is indicative of frequency, amplitude or phase of original voice speech at predetermined instants of time and converts such digitally coded information into at least one digital signal, in parallel form, indicative of any combination of frequency, amplitude or phase relations of the original signals at consecutive instants of time. This digitally coded information is converted into analog signals of substantially the same frequency, amplitude or phase as the original signals.

In accordance with the present invention, a synthesizer for converting consecutive frames of digital words into analog signals includes input logic for receiving the consecutive frames of digital words wherein each frame includes frequency and amplitude information relating to consecutive, predetermined instants of time of a first signal. These digital words are stored in memory as signals indicative of the predetermined frequency and predetermined amplitude of the words of sequential frames which are subsequently transmitted as successive digital signals indicative of the amplitude and frequency of words of subsequent frames into storage elements to produce differential amplitude values at time interpolation intervals between subsequent frames. The differential amplitude values for successive digital signals are utilized to generate a time scaled value for one word of one frame. The time scaled signal is input to an adder for producing a digital signal corresponding to each frame indicative of the sum of the time scaled signals corresponding to the words of each frame. A digital-to-analog converter receives the output of the adder and produces the analog signal corresponding to the first signal.

Further in accordance with the present invention, the time scaled signals are input to arithmetic logic to produce a difference digital signal therefrom. This difference digital signal and a frequency interpolation signal are combined to generate a frequency scaled value for one of the words of one frame from the received digital signal, and transmitting to the adder a time scaled and frequency scaled signal.

A more complete understanding of the invention and its advantages will be apparent from the specification and claims and from the accompanying drawings illustrative of the invention.

Referring to the drawings.

Figure 1:
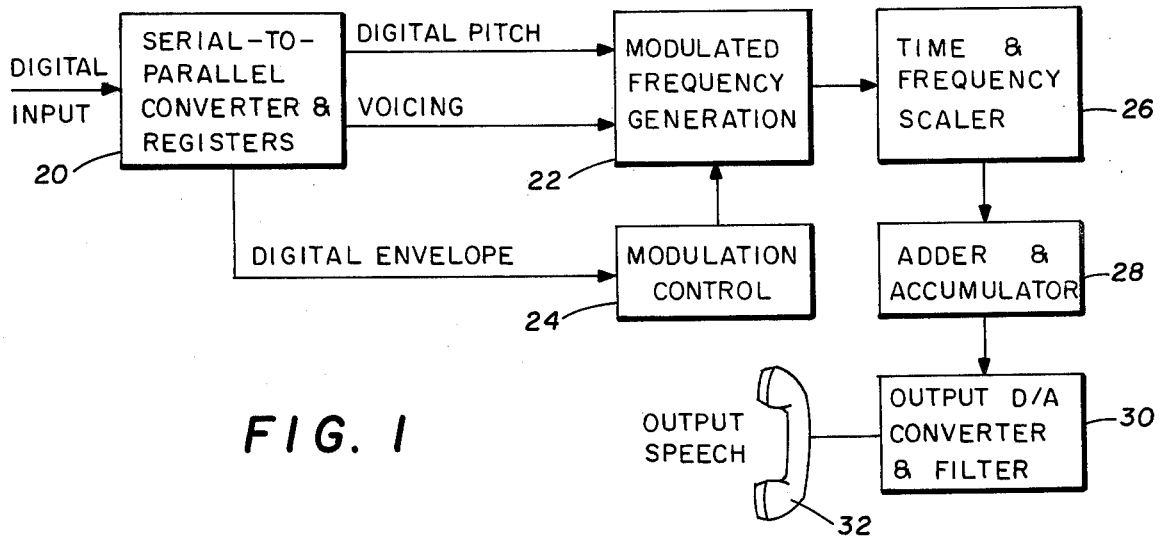
FIG. 1 is a block diagram of a digital synthesizer for providing an analog output signal from digital input data and including time and frequency scaling.
Figure 2:
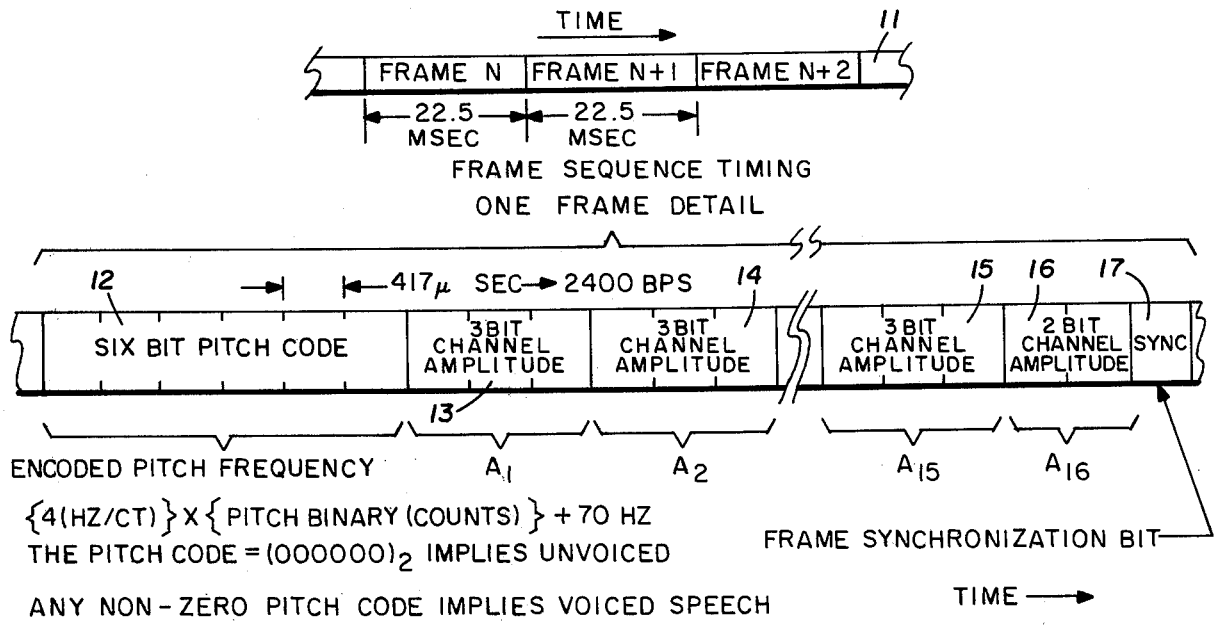
FIG. 2 is a diagrammatic illustration of a digitally coded, serial input signal coupled to the synthesizer of FIG. 1.

Referring now particularly to FIGS. 1 and 2 of the drawing, the illustrated embodiment of the invention is a synthesizer used to convert digitally coded information relating to a first analog signal into analog signals which may in turn be used to reproduce the first signal.

Voice analyzers for translating speech into a digital code or signals are well known. A digital signal produced by one of these analyzers may comprise, as illustrated in FIG. 2, consecutive frames F, such as 11, of digital words containing information relating to the fundamental parameters of speech at consecutive, predetermined, spaced instants of time. In the analyzer described, digital signals are transmitted at the rate of 2400 bits per second. Additionally, each frame contains information relating to whether the speech at a particular instant of time is voiced or unvoiced, a definition of the fundamental frequency of the speech at the given instant to which the frame is related if the sound is voiced sound, and the amplitude of the energy level of a predetermined, consecutive series of bands or spectrum segments spaced within the band of voice frequencies, whether the speech is voiced or unvoiced at that time. Thus, each frame 11 includes 17 words, the first being a 6-bit word, 12, coded to identify the fundamental frequency of the voiced sound or to indicate that there is an absence of voiced sound at an instant of time. Serially presented, following the first word, are fifteen consecutive 3-bit words, such as the 3-bit words 13–17, each being coded to indicate the amplitude of the energy associated with a respective predetermined, consecutive band or spectrum segment of the band of voice frequencies at the one instant of time with which the frame is associated. The seventeenth word, 16, similarly, provides the amplitude information for the sixteenth band, but as opposed to the other words in the series, it does so with two bits; the last bit of the frame being a synchronization bit. For example, the first 3-bit word 13 indicates the amplitude energy of the speech in the band between 200 Hz to 332 Hz and so on with the last word 16 indicating the amplitude of the energy in the spectrum segment between 3331 Hz and 3820 Hz. The consecutive bands of the frame related to a respective word each increase in width with respect to frequency in a predetermined, selected manner, for example, the expansion may be on a logarithmic scale.

The synchronization bit 17 serves to maintain proper synchronization of the timing relationships between the operation of the various circuits of the voice synthesizer 10.

The synthesizer of this invention is a special purpose computing device. It receives the input information at a rate of 2400 bps, and the bit stream consists of serially arranged 54-bit frames of the type previously described.

To fully understand the method of reconstruction of an original, analog signal from the digitally coded information input to the synthesizer 10 reference is made to United States Pat. No. 3,697,699 dated Oct. 10, 1972.

Referring to FIG. 1, the digitally coded information relating to the first analog signal is input to a serial-to-parallel converter 20 that also includes storage registers for holding the data bits for each of the word frames illustrated in FIG. 2. Digital pitch frequency information and digital voicing information stored in the registers of the serial-to-parallel converter 20 are applied to a modulated frequency generator 22 receiving a modulating signal from a modulation control 24. The modulation control 24 receives as an input digital envelope data from the registers of the serial-to-parallel converter 20. Details of the converter 20, frequency generator 22, and the modulation control 24 and the operation thereof is fully described in the U.S. Pat. No. 3,697,699.

An output from the modulated frequency generator 22 is frame data including amplitude and frequency information as applied to a time and frequency scaler 26. An output of the time and frequency scaler 26 is a recreation of the proper amplitude relationship of the original speech spectrum. This is achieved by time smoothing and frequency smoothing the gross spectrum envelope as output from the modulated frequency generator 22. The time and frequency scaled outputs of the scaler 26 are applied to an adder and accumulator 28 that is also a part of the system described in U.S. Pat. No. 3,697,699. Accumulated digital voice data from the adder and accumulator 28 is applied to a digital-to-analog converter and filter 30 for providing an analog signal to drive a headset 32.

Figure 3:
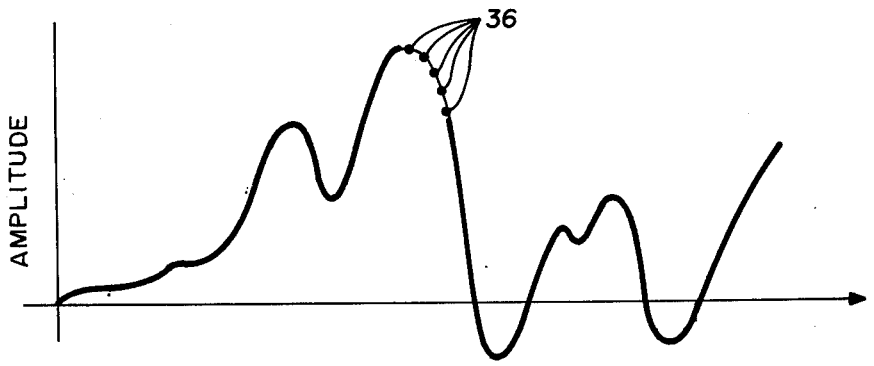
FIG. 3 is a plot of amplitude as a function of time of a typical synthesized analog output provided by the synthesizer of FIG. 1.

Utilizing the frame information of FIG. 2 the system of the previously referred patent generates the individual amplitude points 36, FIG. 3, to produce an analog signal varying in amplitude with time. However, as can be visualized with reference to FIG. 3, to accurately produce the wave illustrated there must be an interpolation between each of the various points 36 on the curve. The time and frequency scaler 26 of FIG. 1 performs the interpolation between each of the points 36 to produce a more continuous amplitude wave with a more even transition between the points 36 than previously obtainable.

Figure 4:
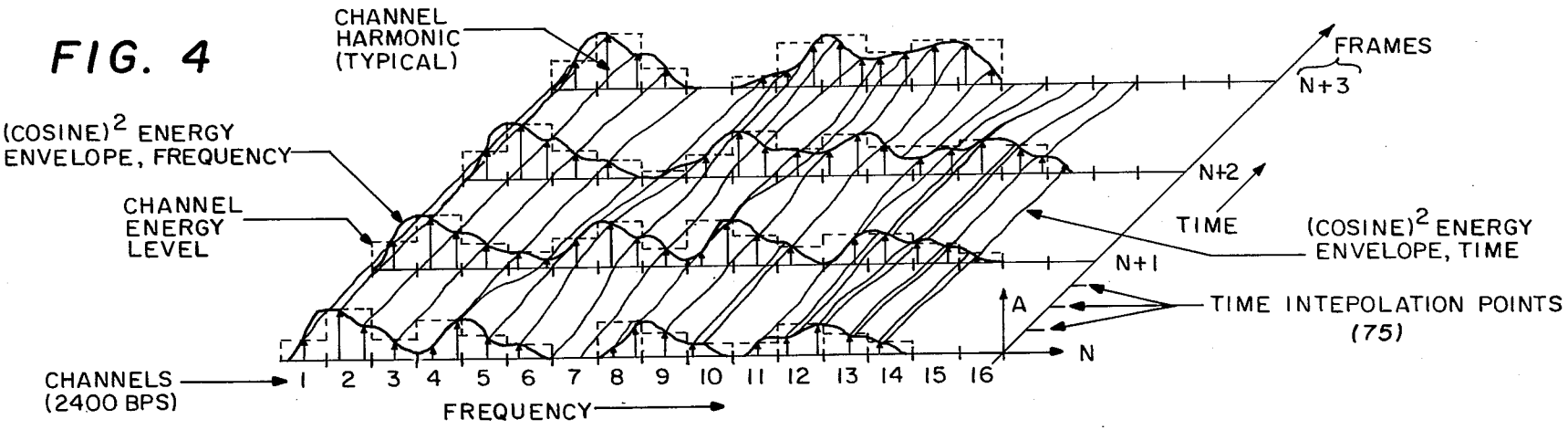
FIG. 4 is a three dimensional time, frequency, amplitude plot showing sixteen channels of frequency data for four individual frames.

Referring to FIG. 4, there is shown a time versus frequency versus amplitude plot of four frames of input data having 16 channels of information wherein the information in each frame is utilized to compute one of the points 36 of FIG. 3. Heretofore, each of the points 36 was calculated for the harmonic frequencies in the sixteen channels of information. With the time and frequency scaler 26 there is a time scaling between subsequent frames and further there is a frequency scaling for each of the channels within a frame and for the time scaled values between subsequent frames.

Figure 5:
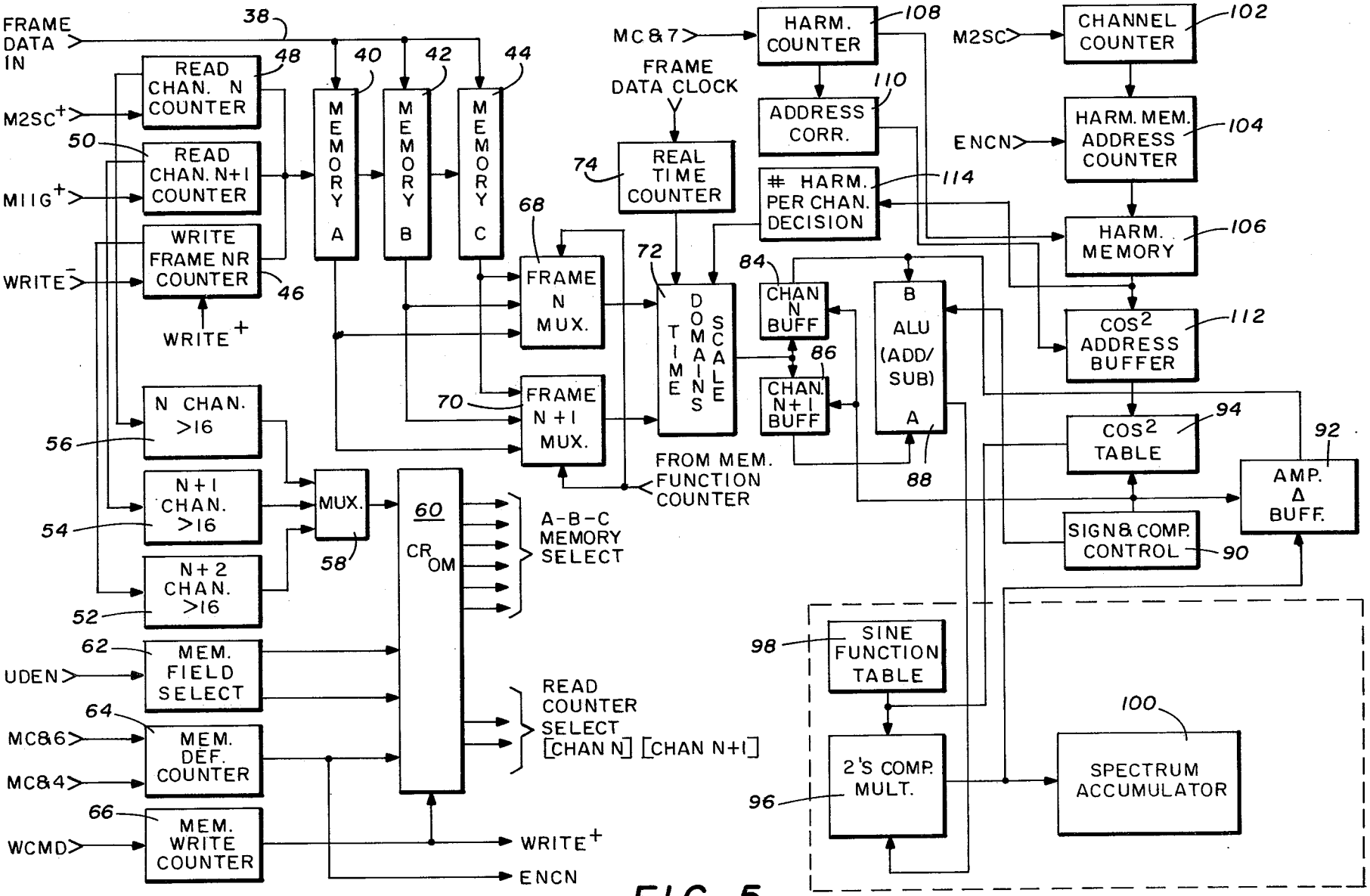
FIG. 5 is a block diagram of the time and frequency scaler of the synthesizer of the present invention.

Referring to FIG. 5, there is shown a block diagram of logic for time and frequency sealing of frames of input data applied from the modulated frequency generator 22 on a line 38 to memory registers 40, 42 and 44. Each subsequent frame of data is written into a different one of the memory registers 40, 42 and 44. That is, with reference to FIG. 4, each of the sixteen channels of information in frame N may be written in any of the memory registers 40, 42 and 44. The control for the selection of the memory register receiving the next frame of input data is determined on the basis of which frames of data are presently being utilized for time scaling.

Write selection of input data into the memory registers 40, 42 and 44 is controlled by a write gate 46 in accordance with a write command on an input line. Data stored in any two of the memory registers to be utilized for time scaling is read out for further processing by control signals from read gates 48 and 50. These read gates receive commands from a central processor control.

When the system of FIG. 5 operates in a mode generating more than sixteen channels in each frame, the gates 46, 48 and 50 also generate control signals to gates 52, 54 and 56, respectively, to select additional channels of storage in the memory registers 40, 42 and 44. Gating signals from the gates 52, 54 and 56 are multiplexed in a multiplexer 58 and applied to a control read only memory 60. This control read only memory provides channel select signals to the memory registers 40, 42 and 44 for the processing of a particular channel of information for a frame of data stored in the memory registers. Also providing input signals to the control read only memory 60 is a memory field select gate 62 responsive to an update enable signal. Also providing control inputs to the control read only memory 60 is a memory definition counter 64 and a memory write counter 66 providing, respectively, read control and write control to the control read only memory 60.

Channel information for subsequent frames of input data as stored in the memory registers 40, 42 and 44 is selectively transferred to multiplexers 68 and 70. The channel data for frame N is transferred into the multiplexer 68 and the channel information for the frame N + 1 is transferred into the multiplexer 70. Under control of a memory function counter (not shown) the channel information in the multiplexer 68 and 70 is transferred into a time domain scaler 72. The time domain scaler 72 functions at a rate determined by the output of a real time counter 74 receiving frame clock data at an input thereto.

In operation of the time domain scaler, channel information for the frame N from the multiplexer 68 is repetitively sampled to generate one of the points 36 on the curve of FIG. 3. At time interpolation points 75, FIG. 4, a time scale is applied to the data channel N in accordance with the present invention. The current frame spectrum information (N frame) along with the next frame spectrum information (N + 1 frame), as input to the time domain scaler 72, is now utilized to change the amplitude value of the N frame information prior to additional processing to generate the analog output as illustrated in FIG. 3.

Figure 6:
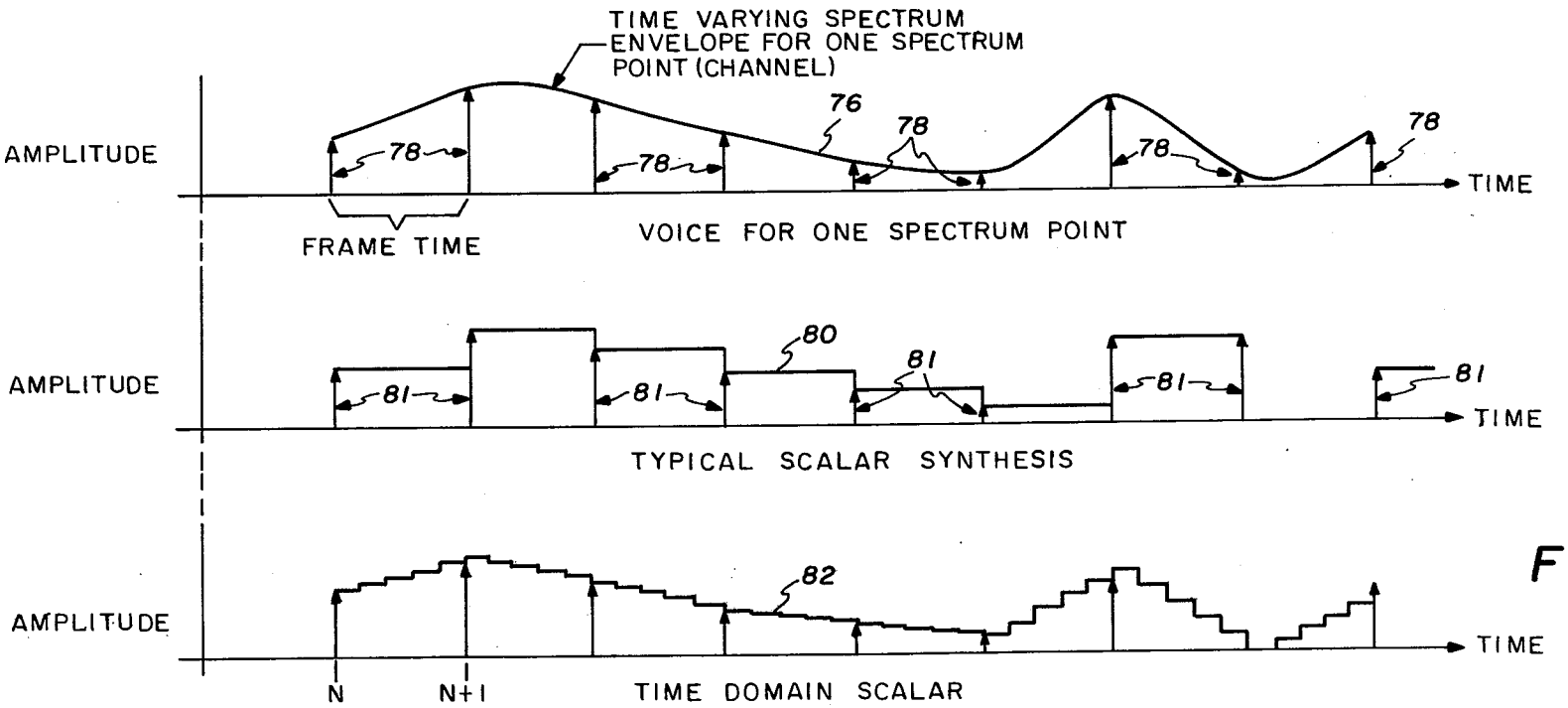
FIG. 6 is a sequence of illustrations of amplitude as a function of time showing time scaling for one spectrum point, that is, one channel of digitally coded input as illustrated in FIG. 2.

Referring to FIG. 6, the envelope 76 represents an original voice spectrum for one of the points 36 of FIG. 3. Each of the amplitude vectors 78 represents amplitude information for one of the frames of information of FIG. 4. Note, that in the original voice spectrum there is a smooth transition of the amplitude between subsequent frame times. The spectrum envelope 80 represents a typical synthesized spectrum for one point 36 of the curve of FIG. 3 wherein the amplitude between subsequent frame times is determined by the amplitude vector 81 of the previous frame. This produces an audibly distinct interruption in a synthesized voice signal.

In accordance with the present invention, with domain scaling the spectrum envelope 82 is generated by the time domain scaler 72. The amplitude value for each frame changes five times prior to the next frame, approaching the value of the amplitude vector for the subsequent frame. By comparison of the three envelopes of FIG. 6, it will be evident that time domain scaling produces an envelope more closely representing the original voice envelopes.

Each intermediate value for the envelope 82 between subsequent frames will be an interpolation that falls on a cosine squared curve applied to amplitude values for the frames N and N + 1. An example of such a curve is given in FIG. 7 and represents the amplitude value between frames N and N + 1 of the envelope 82. Assuming a value of 27 for the amplitude of frame N, and assume for purposes of illustration the following calculation is for channel 6 of FIG. 4, and a value of 63 for frame N + 1, each of the intermediate values at the time interpolation points 75 will be calculated in accordance with the expression:

$$\text{Diff.} = N - (N + 1) \quad (1)$$

$$\Delta = |\text{Diff.}| \cos^2 \phi \quad (2)$$

$$X = \Delta + N \quad (3)$$

where $\phi$ is the angle of advance along the cosine squared curve from the frame N to the frame N + 1 at one of the five time interpolation points 75, and X is the new intermediate value of the spectrum envelope.

Assuming the cosine squared curve varies between 90° and 180° and the time interpolation point is 153°, then the time scaled amplitude value between frame N and N + 1 is computed for the time domain scaler from equations (1), (2) and (3) as follows:

$$\text{Diff.} = 27 - 63 = -36$$

$$\Delta = 36 \cos^2 153° = 28.58$$

$$X = 27 + 28.58 = 55.58$$

Thus, assuming for channel 6 that the amplitude value for frame N is 27 and the amplitude value for frame N + 1 is 63, then the time interpolated value between the subsequent frames will be 55.58. This calculation is made five times for each channel between subsequent frames to produce the envelope 82 of FIG. 6 and the time amplitude plot of FIG. 4 with the time energy envelope extending in the direction of the time axis.

Figures 7, 8, 9:
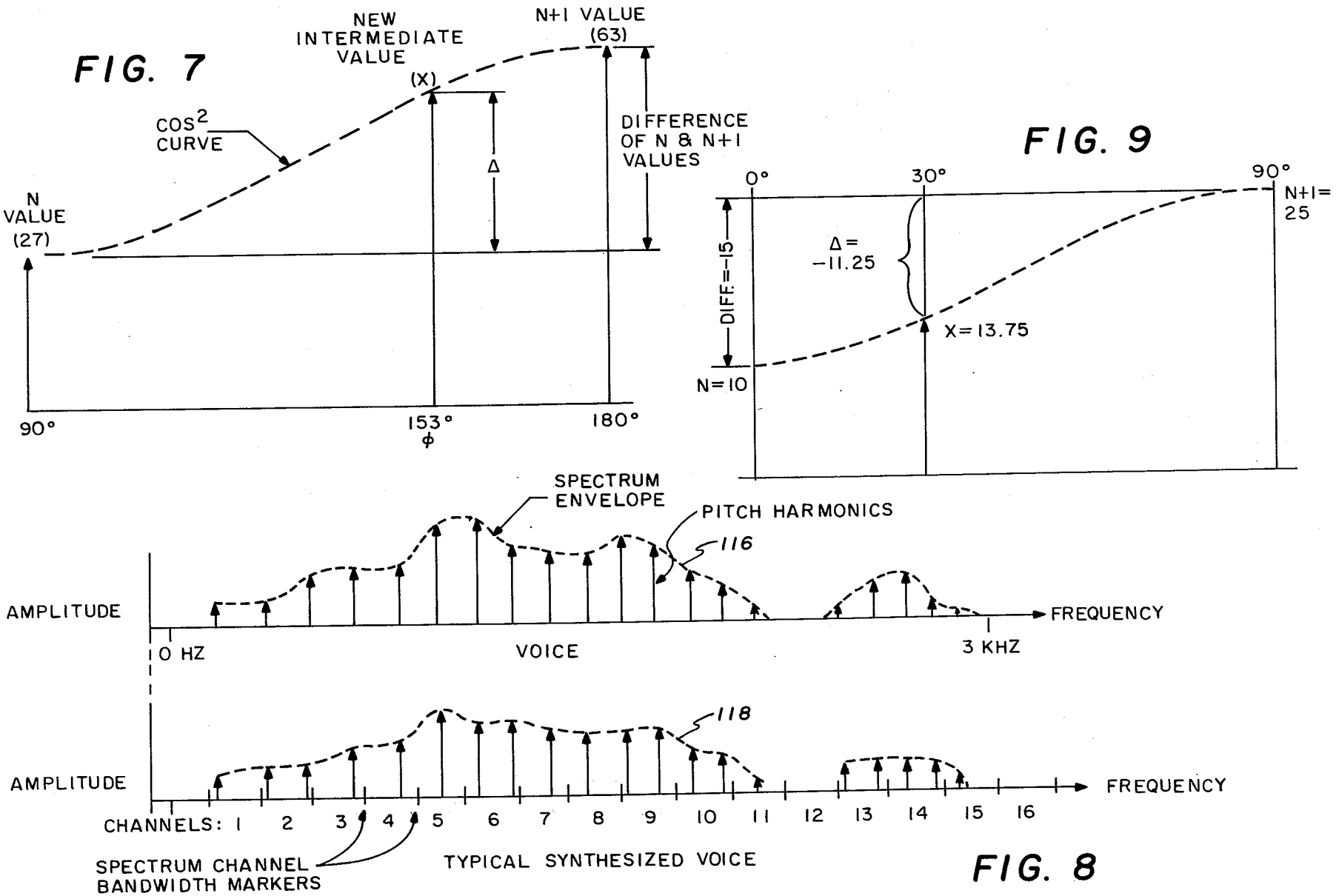
FIG. 7 is a graph of a cosine squared curve for computing the intermediate values of data between frames for time scaling.
FIG. 8 is a sequence of illustrations of amplitude as a function of frequency showing a typical spectrum envelope for an original voice signal and for a typically synthesized voice signal.
FIG. 9 is a graph of a cosine squared curve for computing the amplitude values for a harmonic frequency for subsequent bands or channels as shown in FIG. 8.

In preparation for the time domain scaler 72, amplitude values for the frames N and N + 1 were subtracted and the absolute value of the difference was multiplied by the appropriate cosine squared value extracted from a read only memory. If the difference between the amplitudes of frame N and N + 1 was positive, then the cosine squared curve will be decreasing and the cosine squared value required for the computation described above will be found in the 0° to 90° cosine squared curve. If the amplitude value of the frame N + 1 was larger than the amplitude value of the frame N, the cosine squared curve is increasing as illustrated in FIG. 7 and the value is found in the 90° to 180° cosine squared wave, as per the above example. These computations for all combinations of N and N + 1 values are stored in a read only memory to be read during operation as required.

Summarizing the operation of the time scaling function of the time and frequency scaler 26, each of the amplitude values of the 16 channels of frame N and the corresponding amplitude values for each of the channels of the frame N + 1 are input to the time domain scaler 72 from the multiplexers 68 and 70 to address a ROM for the correct precomputed amplitude value for the curve extending along the time axis of FIG. 4. The time between the frame N data and the frame N + 1 data is divided into five equal segments, and for each segment the amplitude value is found by addressing a read only memory. Typically, the time scaled envelope extending in the direction of the time axis is illustrated by the envelope 82 of FIG. 6.

It should be understood that more than one scaling operation is made between each time interpolation interval 75 between the frames N and N + 1. Typically, a scaling operation will be made every eleven to fifty-eight microseconds with the result that the envelope 82 of FIG. 6 is a composite of many individual interpolations.

After completion of time scaling, time scaled data from the time domain scaler 72 is input to the frequency domain section of the system of FIG. 5. Time scaled data for frame N (including date for each time interpolation interval 75) is input to the channel "N" buffer 84 and time scaled data from frame N + 1 (also including data for each time interpolation interval 75) is input to a channel "N + 1" buffer 86. This is the information utilized by the frequency domain section of the scaler 26 to compute the amplitude of each harmonic based on the number of harmonics contained in a channel and which harmonic (first, second, etc. harmonic) is being processed.

Initial computations for frequency domain scaling are completed in an arithmetic unit 88 responsive to data in the buffers 84 and 86. The arithmetic logic unit 88 is actuated by a controller 90 that also provides gating signals to the buffers 84 and 86 and an amplitude delta buffer 92. Further, the controller 90 provides signals to a cosine squared table memory 94.

Initially, data in the buffers 84 and 86 is mathematically subtracted in the arithmetic logic unit 88 and the result is transferred as differential data to a "2's" complement multiplier 96. Also input to the "2's" complement multiplier 96 during the frequency domain scaling is a value from the cosine squared table memory 94. These two inputs are multiplied and transferred to the amplitude delta buffer 92. During the next time interval, the amplitude data in the buffer 92 and the time scaled data from the N + 1 buffer 86 are input to the arithmetic logic unit 88 where the data is added to produce data for one harmonic of a channel which is input to the "2's" complement multiplier 96.

At this time, a value from a sine function table register 98 is input to the multiplier 96 for further processing in accordance with the operation described in the U.S. Pat. No. 3,697,699. Thus, during this second clock time the time and frequency scaled data for one harmonic of a channel is processed through the multiplier 96 to an accumulator 100 of the synthesizer as described in U.S. Pat. No. 3,697,699.

To provide values of the cosine squared function to the "2's" complement multiplier 96, a channel counter 102 responds to a control signal to provide a channel marker to a harmonic memory controller 104. The harmonic memory controller 104 receives an enable count signal and provides an input to a harmonic memory register 106. The harmonic memory stores the number of harmonics found in a particular channel of frame N and receives harmonic count information from a harmonic counter 108. The harmonic counter 108 also inputs to an address correction register 110, which along with the harmonic memory 106, provides an input to the cosine address buffer 112. The cosine address buffer 112 generates an address for selecting the cosine squared data from the table of the storage 94. Also controlled by the output of the harmonic memory 106 is a decision controller 114 connected to the time domain scaler 72.

Referring to FIG. 8, there is shown an original voice spectrum envelope 116 for one of the transmitted frames. There is a smooth transition of the amplitude of the envelope 116 between adjacent pitch harmonic vectors. These harmonic vectors may each be in a separate channel or more than one harmonic may be in any of the sixteen channels as illustrated in FIG. 4. Digital data derived from the energy of the envelope 116 is time scaled and applied to the frequency domain scaler to generate a synthesized envelope 118. To provide the smooth transition between each of the pitch harmonics of the various channels, the arithmetic logic unit 88 and the 2's complement multiplier 96 scale the data for each computation associated with the data for frame N. These computations are made for each of the time interpolation intervals 75 between frame N and frame N + 1.

At the first channel for frame N, the harmonic counter 108 is reset. Each harmonic of a channel, such as channel 13 of FIG. 8, is then counted and the result is stored in the harmonic memory 106. The number of harmonics per channel remains constant for all the computations of a given frame and, thus, the memory 106 contains the correct number of harmonics per channel for all speech samples except the first sample in each frame. The first sample in each frame will be scaled using the information that was valid from the previous frame and this correction is provided by an address correction controller 110.

The number of harmonics in a channel is used to address the cosine squared table register 94 which is composed of eight fields of data, one of which is selected based on the number of harmonics in the correct channel. The fields are selected as follows:

| FIELD # | SELECTION CONDITION |
|---|---|
| 1 | 1 Harmonic Per Channel |
| 2 | 2 Harmonics Per Channel |
| 3 | 3 Harmonics Per Channel |
| 4 | 4 Harmonics Per Channel |
| 5 | 5 Harmonics Per Channel |
| 6 | 6 Harmonics Per Channel |
| 7 | 7 Harmonics Per Channel |
| 8 | 8 Harmonics Per Channel |

Each of the fields contains eight words of eight bits each with the first word in each field equal to the cosine squared value of 0°. The second word in each field is the cosine squared function at 90° divided by the number of harmonics in the channel, that is, $\text{cosine}^2(90°/3 = \text{cosine}^2 30° = 0.75)$. The third word is the cosine squared function of two times the quotient of 90° divided by the number of harmonics per channel, that is, $\text{cosine}^2 2(90°/3) = \text{cosine}^2 60° = 0.25)$. The value of the words in the remainder of the field are calculated by an extension of the previous two examples.

The frequency scaling operation computes a value which is based upon a cosine squared function varying between 0° and 90°. The value for N + 1 is subtracted from the value for N. The difference is then multiplied times the cosine squared value which is a function of the time segment currently being synthesized. The product (the Δ value) is then added to the N + 1 value to produce the new intermediate value (X). If the difference in this computation is positive, the delta will also be positive and the new value (X) will be larger than N + 1, thus indicating a decreasing function. If, however, the difference is negative, the delta value will also be negative and the new value (X) will be smaller than N + 1, indicating an increasing function. An example of such an increasing function is shown in FIG. 9 where the amplitude of the harmonic N equals 10 and the amplitude of the harmonic N + 1 equals 25.

The computation in the arithmetic logic unit 88 is based on the expression:

$$\text{Diff.} = \text{harmonic N} - (\text{harmonic N} + 1), \quad (4)$$

and this value is transferred to the "2's" complement multiplier 96 where it is multiplied with a value from the cosine squared table 94 in accordance with the expression:

$$\Delta = \text{Diff.} \cos^2 \phi \quad (5)$$

where $\phi$ is the angle of the computation between the harmonic N and the harmonic N + 1. This value is then returned to the arithmetic logic unit 88 where it is added to the value of the harmonic N + 1 in accordance with the expression:

$$X = (\text{harmonic N} + 1) + \Delta \quad (6)$$

With reference to FIG. 9, as an example of the computation completed by the frequency domain scaler, the value of the envelope 118 between the harmonic N and the harmonic N + 1 is computed using the Equations 4, 5 and 6 as follows:

$$\text{Diff.} = 10 - 25 = -15$$

$$\Delta + -15 \cos^2 30° = -11.25$$

$$X = 25 + (-11.25) = 13.75$$

Thus, for the computation at the angle 30° on the cosine squared function between the harmonic N and the harmonic N + 1 the amplitude is equal to 13.75. As explained previously, a computation is made for each frame of data, as input to the memory registers 40, 42 and 44, and also for each time scaled value for the time interpolation intervals 75 between the frames N and N + 1.

The output from the "2's" complement multiplier 96 is applied to the accumulator 100 and is time and frequency scaled to produce one of the points 36 on the curve of FIG. 3.

Figure 10A:
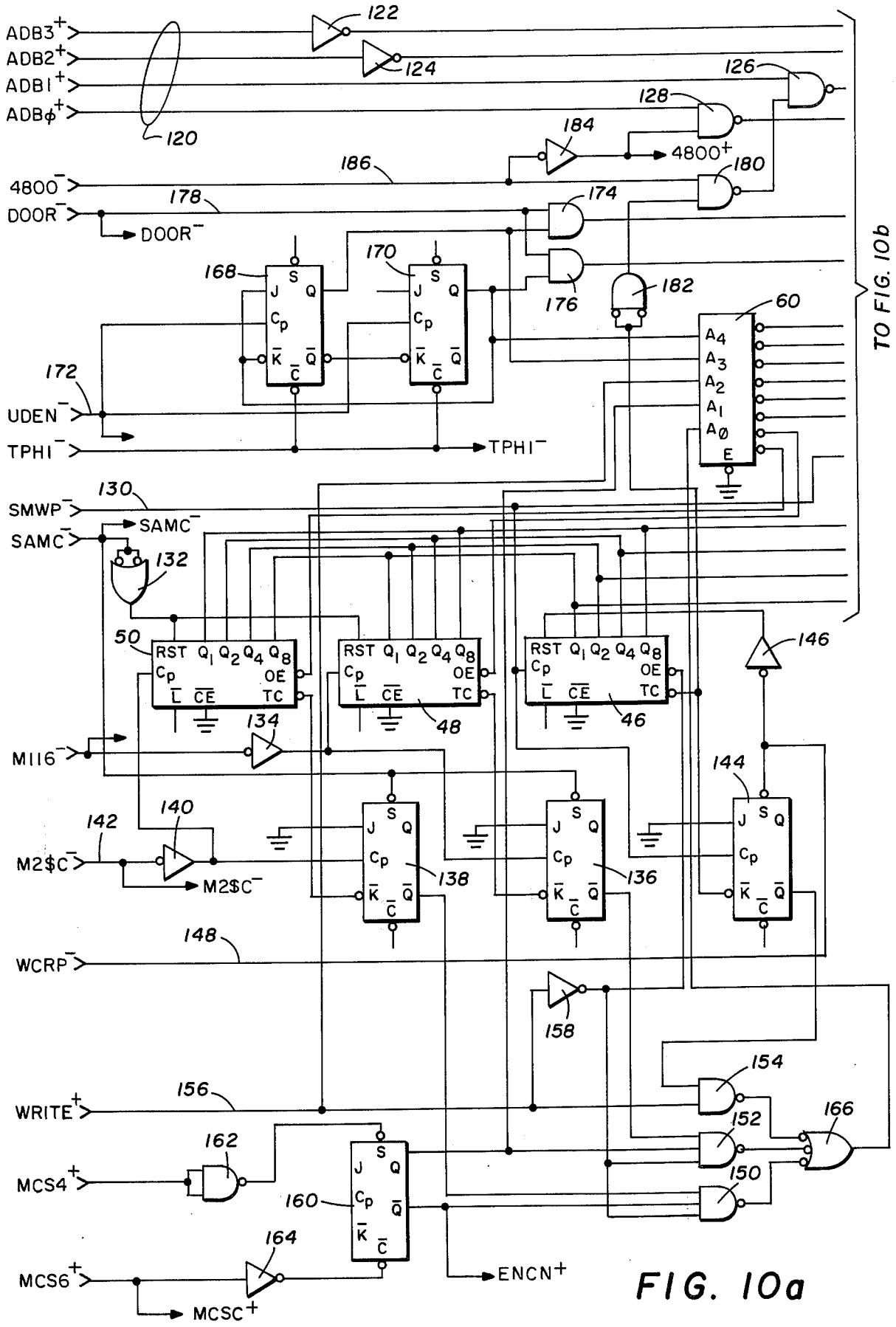
FIGS. 10a and 10b show a logic schematic of the system of FIG. 5 up to and including the frame N and frame N + 1 multiplexers.
Figure 10B:
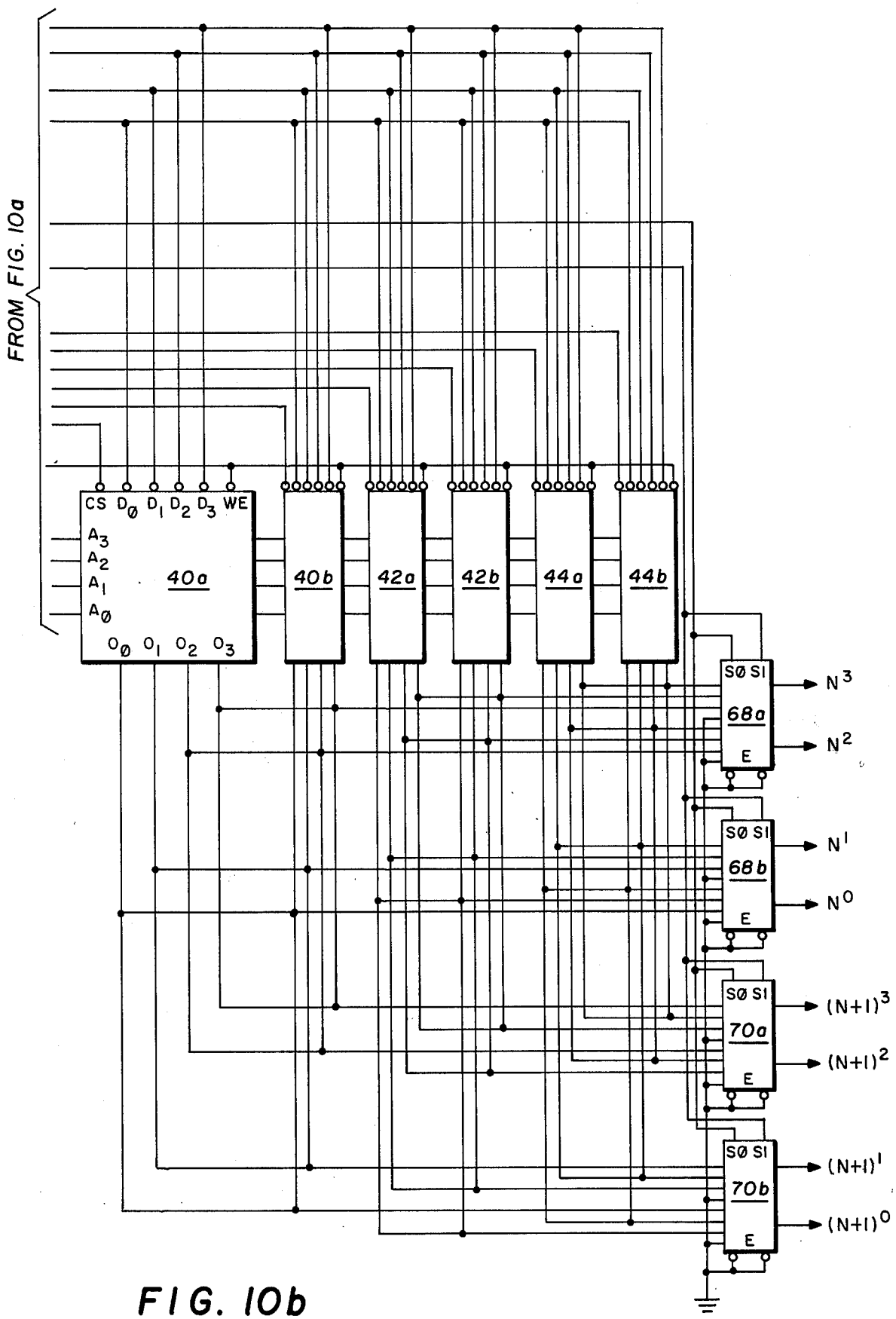

Referring to FIG. 10, there is shown a detailed logic schematic of the time and frequency spectrum scaler of FIG. 5 up to and including the multiplexers 68 and 70. Frame data in the form of four data bits is applied to data lines 120. Two of the data lines include inverters 122 and 124 and the remaining two data lines are connected to one input of NAND gates 126 and 128, respectively. At the output of the inverters 122 and 124 and the NAND gates 126 and 128 the data lines are input to random access memories 40*a*, 40*b*, 42*a*, 42*b*, 44*a*, and 44*b* corresponding with the memory registers 40, 42 and 44 of FIG. 5. Each of the random access memories may be of a type identified with the trade identification No. 27S03. When each frame contains only sixteen channels of information, such as in the example being described, only half of the random access memories would be required; the implementation as shown in FIG. 10 provides for frame data having up to thirty-two channels.

Frame data on the lines 120 is selectively input to the random access memories in accordance with address information generated at the output of counter 46. The counter 46 and each of the random access memories is pulsed by a spectrum memory write pulse (SMWP) generated on the line 130. This pulse is generated when the random access memories are available for writing in data appearing on the lines 120. When all the data for a particular frame including all channels of information has been written into one of the random access memories, a sample complete pulse (SAMC) is generated to a NOR gate 132 to reset the counters 48 and 50 for the next computation for time scaling.

The counters 48 and 50 are now ready to generate a read address to transfer the data for frame N and frame N + 1 from two of the random access memories to the multiplexers 68*a*, 68*b* and 70*a*, 70*b*, respectively. Which of the random access memories will be addressed for reading into the multiplexers varies with the location of the data for frame N and frame N + 1. If during one frame the memories 40*a* and 40*b* contain the data for frame N and the memories 42*a* and 42*b* contain the data for frame N + 1 and are read into the multiplexers 68 and 70, then for the subsequent frame the memories 42*a* and 42*b* and 44*a* and 44*b* will contain the data for frames N and N + 1, respectively, and be read into the multiplexers 68 and 70. That is, in the subsequent frame the memories 42*a* and 42*b* will contain data for frame N and the memories 44*a* and 44*b* will contain the data for frame N + 1. This sequence rotates with two of the memories being read into the multiplexers while the third is available for receiving additional frame data on the lines 120.

To read channel information for a given frame from one of the random access memory pairs a marker pulse (M116) is generated at the input of an inverter amplifier 134 having an output connected to the read counter 48 and also to a flip-flop 136. The flip-flop 136 is part of the memory field select logic 62 that also includes a flip-flop 138 driven by the output of an inverter 140 also connected to the counter 50. The inverter 140 receives a marker pulse (M2SC) on a line 142. Both the flip-flops 136 and 138 are set by the sample complete signal (SAMC) at the input of the NOR gate 132. Also comprising a part of the memory field select logic 62 is a flip-flop 144 responsive to the write counter 46 terminal count and generating an input to gate 154. The counter 46 is reset by a write counter reset pulse (WCRP) on a line 148 connected to the input of the inverter 146.

Output pulses from the flip-flops 136 and 138 are input to NAND gates 150 and 152 also as part of the memory field select logic 62 that includes a NAND gate 154. Inputs to the NAND gate 154 include the output of flip-flop 144 and a write command on the lines 156. The write command is also applied to an inverter 158 that controls the counter 46. The output of the inverter 158 is also applied to inputs of the NAND gates 150 and 152. A third input to each of the NAND gates 150 and 152 are timing pulses generated at the output of a flip-flop 160. The flip-flop 160 is set by a timing pulse at the output of a NAND gate 162 and cleared by an output of an inverter 164.

Outputs of the NAND gates 150, 152 and 154 are input to a NOR gate 166 having an output connected to the control read only memory 60.

As explained, the control read only memory 60 provides signals to select which of the random access memories will be gated to receive the next frame data or from which memory current frame data will be read. In addition to the output of the NOR gate 166, the control read only memory 60 also receives an input signal from the flip-flop 160 and the write pulse on the line 156. Additional inputs to the control read only memory 60 are from the memory definition counter 64 comprising flip-flops 168 and 170. During the time period for updating information in one of the random access memories, an update enable signal (UDEN) is generated on a line 172 to each of the flip-flops 168 and 170. This sets each of the flip-flops to generate an activating pulse to the control read only memory 60.

Additional logic of FIG. 10 includes NAND gates 174 and 176 having inputs connected to the flip-flops 168 and 170, respectively, and also receiving as an input a disable out of range pulse (DOOR) on a line 178. Outputs of the NAND gates 174 and 176 control the multiplexer logic 68*a*, 68*b*, 70*a* and 70*b*.

Part of the logic of FIG. 10 is to enable the system to operate from either sixteen channel frame data or up to thirty-two channel frame data. This logic includes the NAND gate 128 and also NAND gates 180 and 182 along with an inverter 184. By operation of this logic, and a signal on the line 186, the full storage capability of the memories 40, 42 and 44 is made available for the storage of frame data.

Figure 11:
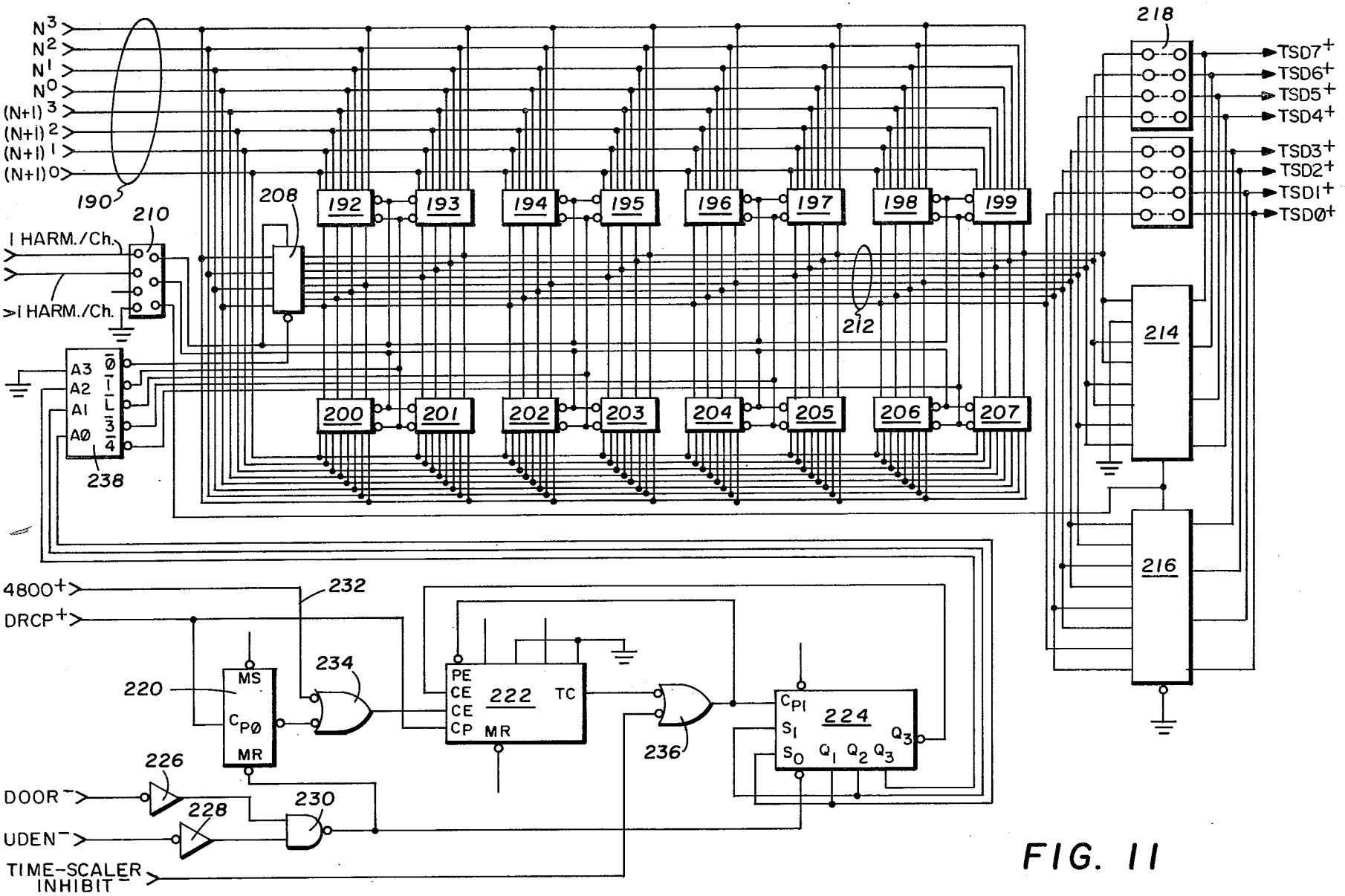
FIG. 11 is a logic schematic of the spectrum contour scaler time domain section for the system of FIG. 5.

Referring to FIG. 11, there is shown logic for the time domain scaler 72 wherein the digital data for the frame N and the frame N + 1 from the multiplex registers 68*a*, 68*b*, 70*a* and 70*b* is transmitted over data lines 190. These data lines are inputs to read only memories 192–207. A read only memory 208 contains the scaling factors for the first time interpolation interval of FIG. 3. The read only memories 192, 193, 200 and 201 store scaling factors for the second time interpolation interval while the read only memories 194, 195, 200 and 203 store the scaling factors for the third time interpolation interval. Similarly, the read only memories 196, 197, 204 and 205 contain scaling factors for the fourth time interpolation interval and the scaling factors for the fifth time interval are stored in the read only memories 198, 199, 206 and 207.

As arranged in FIG. 11, the read only memories 192–199 store scaling factors for those channels of information having only one harmonic. The read only memories 200–207 store the scaling factors when more than one harmonic is found in each of the channels. Selection of the read only memories in the group 192–199 or the read only memories in the group 200–207 is determined by the output of patch block logic 210 receiving two input signals, one input indicating a one harmonic channel condition and the second input indicating a more than one harmonic channel condition. When one harmonic exists in the channel, then the frame data on the data lines 190 is input to the read only memories 192–199 and 208. When more than one harmonic is in each channel, the input data is input to the read only memories 200–208.

The time scaled frame data is output from the read only memories 192–208 on data lines 212.

In addition to the two banks of read only memories 192–207, the time scaler logic also includes multiplexers 214 and 216. The data lines 212 are input to the multiplexers 214 and 216 and in addition are connected to patch block logic 218. When more than one harmonic is found in a channel, a selection can be made through the patch block logic 210 to pass the scaled data through the multiplexers 214 and 216 to provide additional data scaling. This additional scaling applies a scale factor to each of the data words equal to fifty percent of the value when only one harmonic exists per channel. When the fifty percent scaling is not selected, the scaled data on the data lines 212 is direct coupled through the patch block logic 218 to the buffers 82 and 86.

Timing of the operation of the scaling logic is provided by timing components including a flip-flop 220 and registers 222 and 224. The disable out of range (DOOR) signal and the update enable (UDEN) signal are respectively applied to inverter 226 and a NAND gate 230 having an output connected to the flip-flop 220 and the register 224.

When more than sixteen channels comprise a frame of information a signal on the line 232 is applied to a NOR gate 234 that also has an input from the flip-flop 220 from an output to the register 222. Also included in the timing logic is a NOR gate 236 responsive to a time scale inhibit signal and interconnected between the registers 222 and 224.

Timing signals from the register 224 are applied to conversion logic 238 for converting the timing signals into pulses for selecting the various interpolation intervals 75 for time scaling between frame N and frame N + 1. Each of the interpolation interval pulses are applied to the various read only memories 192–208 to control the memory selection depending on the interpolation interval of the time scaler.

Figure 12A:
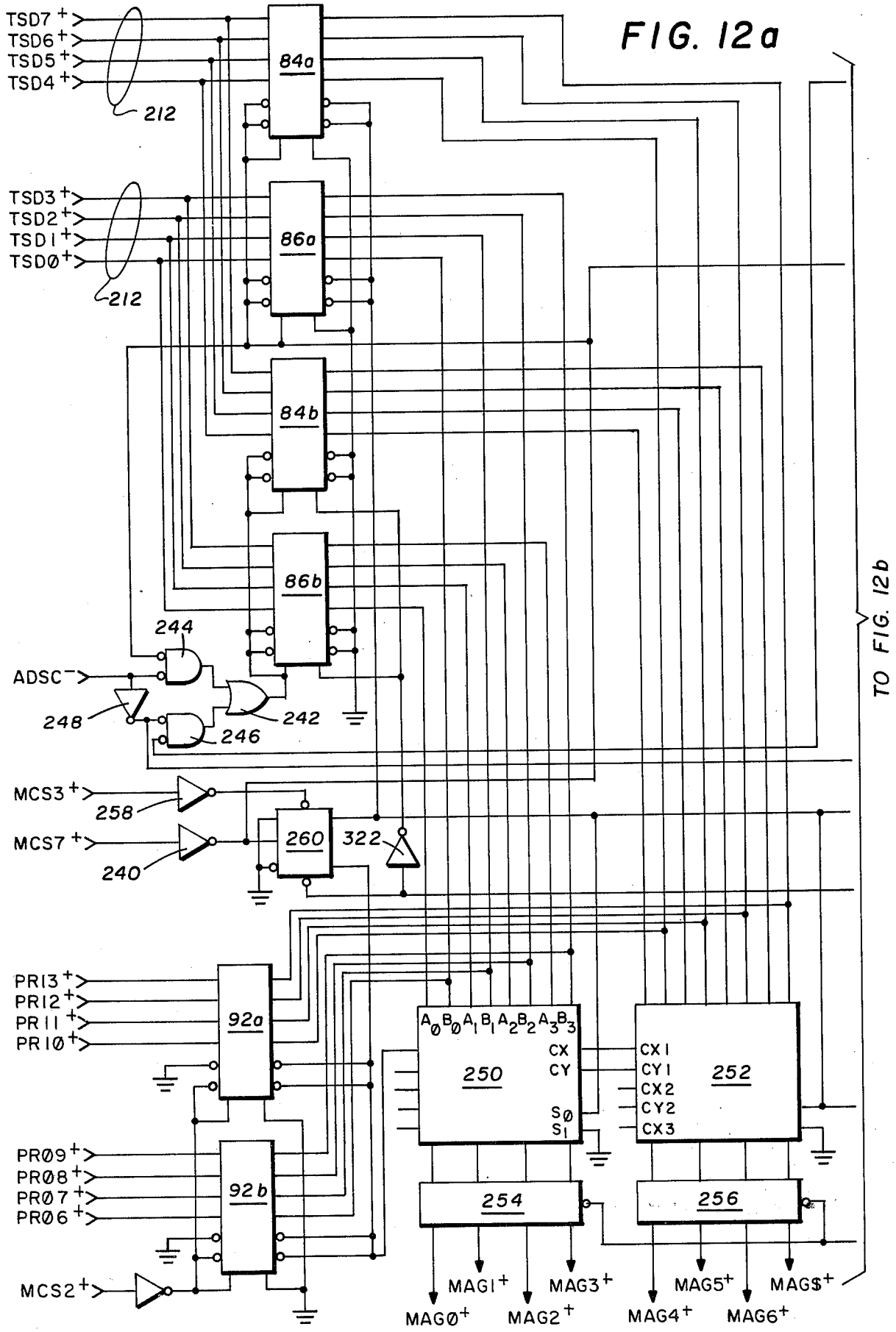
FIGS. 12a and 12b show a logic schematic of the spectrum contour scaler frequency domain section for the system of FIG. 5.
Figure 12B:
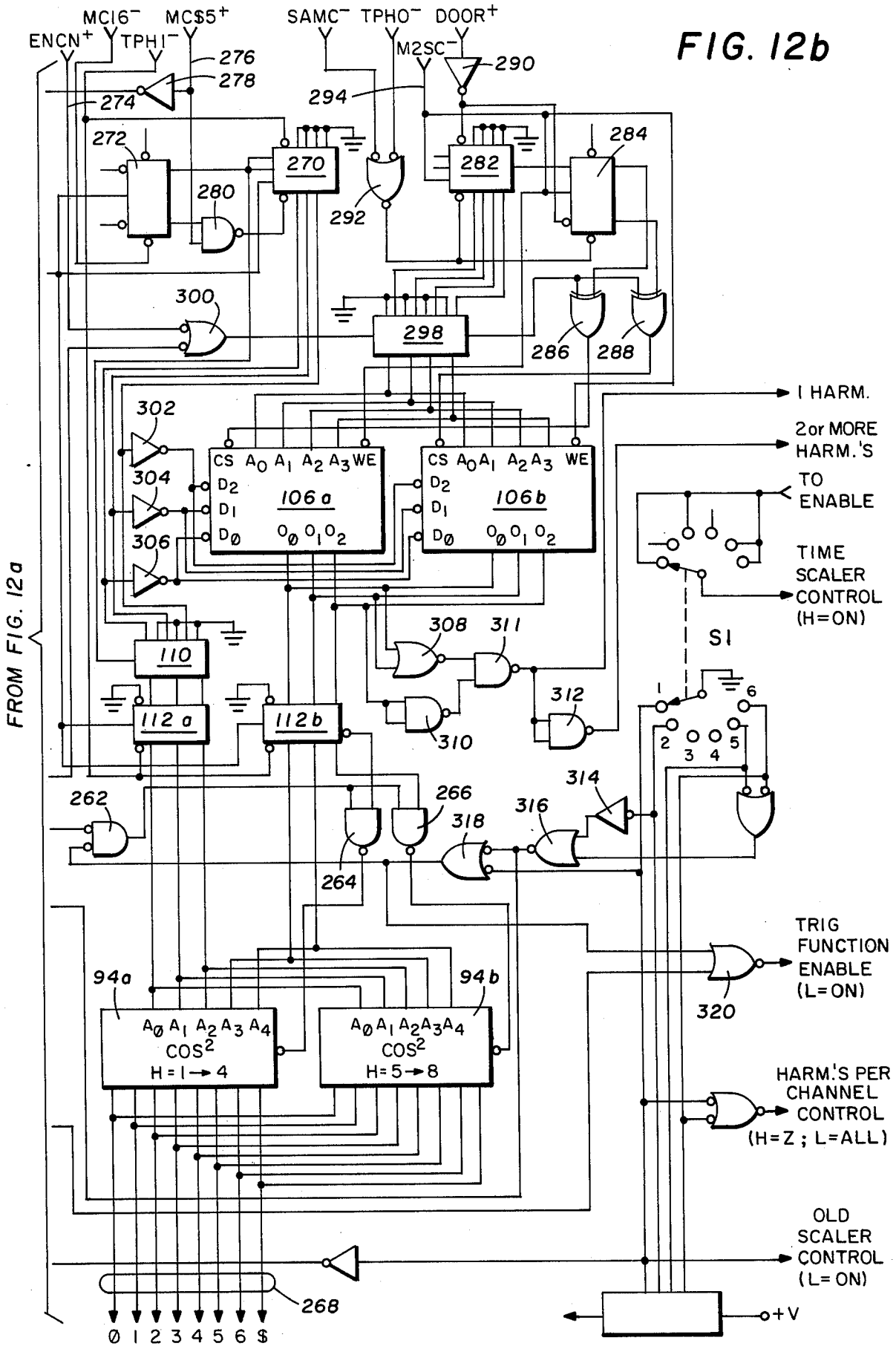

Referring to FIG. 12, time scaled data on the data lines 212 is applied to registers 84*a* and 84*b* of the channel N buffer 84 and also to the registers 86*a* and 86*b* of the channel N + 1 buffer 86. That is, time scaled data for frame N is input to the registers 84*a* and 84*b* while the data for frame N + 1 is input to the registers 86*a* and 86*b*.

The registers 84*a* and 86*a* are loaded during a time interval established by a timing signal applied to the input of an inverter 240. The registers 84*b* and 86*b* are controlled by the output of an OR gate 242 as part of logic including NAND gates 224 and 246 and an inverter 248.

Data in the registers 84*a*, 84*b*, 86*a* and 86*b* is transferred to the arithmetic logic unit 88 comprising arithmetic logic units 250 and 252. Computing signals from the arithmetic logic units 250 and 252 are outputs to the "2's" complement multiplier 96 through test logic 254 and 256, the latter forming no part of the present invention.

Computational control signals from the controller 90 to the buffers 84 and 86 are provided by logic of FIG. 12 including the inverter 240 and an inverter 258 each having outputs coupled to a flip-flop 260. Outputs from the flip-flop 260 are coupled to the registers 84*a* and 86*a* and in addition to registers 92*a* and 92*b* of the delta buffer 92. Input data to the registers 92*a* and 92*b* is from the "2's" complement multiplier 96 and provides outputs coupled to the arithmetic logic units 250 and 252 as one factor for the computational process as explained previously.

Control signals from the flip-flop 260 are also coupled to the cosine squared table memory 94 consisting of read only memories (ROMs) 94*a* and 94*b*. These control signals are provided to the memories 94*a* and 94*b* through NAND gates 262, 264 and 266. Cosine squared data input to the memories 94*a* and 94*b* is provided by the output of registers 112*a* and 112*b* of the address buffer 112. The cosine squared data from the memories 94*a* and 94*b* is input to the "2's" complement multiplier 96 over data lines 268.

The buffer register 112*a* stores harmonic per channel data generated at the output of a channel counter register 270. This register is set by the output of a flip-flop 272 responsive to the bandwidth marker pulses on a line 274 and also responsive to timing pulses at the output of the inverter 240. The timing function for the channel counter register 270 is controlled by timing pulses on a line 276 coupled to a NAND gate 280 and also through an inverter 278 to the NAND gate 246. The harmonic per channel data is provided to the address correction register 110 connected to the output of the register 270 and to the buffer register 112*a*.

As discussed previously, the frequency scaling computation varies by channel as determined by the channel counter 102. The channel counter 102 comprises a register 282 driving a flip-flop 284 which in turn has outputs through gating logic 286 and 288. Both the register 282 and the flip-flop 284 respond to the disable out of range pulse (DOOR) coupled through an inverter 290. These logic units are also set by the output of a NOR gate 292 and receive timing pulses on a line 294.

The actual harmonic count as generated in the register 270 is gated into harmonic memories 106*a* and 106*b* of the harmonic memory 106. This data is gated into memories 106*a* and 106*b* through the memory controller 108 comprising a register 298 responsive to timing pulses from a NOR gate 300 which in turn receives an enable channel N pulse (ENCN) and also a timing signal from the output of the inverter 248 and according to addressing information provided by channel counter 282 through the register 298. Data representing the number of harmonics per channel transferred to the memories 106*a* and 106*b* are coupled from the register 270 through inverters 302, 304 and 306. The harmonic count and the channel number are input to the read only memories 94*a* and 94*b* through the buffer register 112*b*.

Additionally, output data from the memories 106*a* and 106*b* is provided to gating logic for generating the harmonic signals to the patch block logic 210 of FIG. 11. This gating logic includes an OR gate 308 and NAND gates 310–312.

To set the logic of FIG. 12 for the frequency scaling function, a control process pulse is applied through an inverter 314 as one input to an OR gate 316 having an output to a NOR gate 318. A NOR gate 318 is coupled to the NAND gate 262 and also to an OR gate 320 for providing a signal to the "2's" complement multiplier 96 to function in the TRIG function enable mode. This is the mode described in detail in the previously referred to United States patent. Also input to the OR gate 320 is the output of the flip-flop 260 as a timing pulse. The output of the OR gate 316 is provided to the flip-flop 260 and through an inverter 322 to the registers 84*b* and 86*b*.

Functionally, the logic of FIGS. 10–12 completes the time and frequency scaling as described previously with regard to the block diagram system of FIG. 5. Output data from the registers 254 and 256 is time and frequency scaled thereby minimizing distortion in the reconstruction of voice speech in accordance with the process described in the aforementioned United States patent.

While only one embodiment of the invention, together with modifications thereof, has been described in detail herein and shown in the accompanying drawings, it will be evident that various further modifications are possible without departing from the scope of the invention.

What is claimed is:

1. A synthesizer for converting consecutive frames of digital words into analog signals, such consecutive frames including frequency and amplitude information relating to consecutive predetermined instants of time of a first signal, and one word of each frame comprising a channel containing fundamental frequency information bits relating to the fundamental frequency of the original signal at one instant of time, and other consecutive words of each frame comprising channels containing amplitude information bits of consecutive, predetermined frequency bands of the first signal, said bands having a predetermined relation to the fundamental frequency of the first signal at one instant of time, said synthesizer including:

input means for receiving consecutive frames of digital words;

first means connected to said input means and including memory means for storing digital signals indicative of the predetermined frequency and predetermined amplitude of the words in channels of sequential frames, and means operatively associated with said memory means for causing said memory means to transmit successive digital signals indicative of the amplitude and frequency of words of subsequent frames;

second means connected to said first means and including storage means of the differential of amplitude values of words at time interpolation intervals between subsequent frames, and means for receiving successive digital signals indicative of the amplitude of words of subsequent frames, and for generating from the differential of amplitude values and the received digital signals a time scaled value for one of the words of one frame for the receive digital signal; and adder means for receiving the digital words from said second means and for producing a digital signal corresponding to each frame and indicative of the sum of the time scaled signals corresponding to the words of each frame; and a digital-to-analog converter for receiving the output of said adder means and producing an analog signal corresponding to said first signal.

2. A synthesizer for converting consecutive frames of digital words into analog signals as set forth in claim 1 wherein said second means includes means for generating a time scaled value at five time interpolation intervals.

3. A synthesizer for converting consecutive frames of digital words into analog signals as set forth in claim 1 wherein said memory means includes storage elements for three sequential frames of frequency and amplitude words.

4. A synthesizer for converting consecutive frames of digital words into analog signals as set forth in claim 3 including control means for reading digital signals from selected storage elements to said second means and providing digital signals into selected storage elements from said input means.

5. A synthesizer for converting consecutive frames of digital words into analog signals as set forth in claim 1 including a counter connected to said storage means for establishing the time interpolation intervals between subsequent frames of digital words.

6. A synthesizer for converting consecutive frames of digital words into analog signals as set forth in claim 1 wherein said storage means includes an array of memories, one memory for each time interpolation interval.

7. A synthesizer for converting consecutive frames of digital words into analog signals as set forth in claim 6 wherein said storage means includes more than one array of memories, each array selectable by the number of harmonics in a channel.

8. A synthesizer for converting consecutive frames of digital words into analog signals as set forth in claim 1 including means responsive to the number of channels in a frame for selecting the memory elements for storage of digital words from said input means.

9. A synthesizer for converting consecutive frames of digital words into analog signals, said consecutive frames including frequency and amplitude information relating to consecutive, predetermined instants of time of a first signal, and one word of a channel of each frame containing fundamental frequency information bits relating to the fundamental frequency of the first signal at any one instant of time, and other consecutive words of channels of each frame containing amplitude information bits of consecutive, predetermined frequency bands of the first signal, said bands having a predetermined relation to the fundamental frequency of the first signal at one instant of time, said synthesizer including:

input means for receiving said consecutive frames of digital words;

first means connected to said input means and including multiple arrays of memory means having selectable storage elements for storing digital signals indicative of the predetermined frequency and predetermined amplitude of the words of sequential frames, and control means for writing digital signals into selected storage elements from said input means and for reading digital signals from selected storage elements to transmit successive digital signals indicative of the amplitude and frequency of words of subsequent frames;

second means connected to said first means and including an array of memory means for receiving the differential of amplitude values of words at a time interpolation interval between subsequent frames, and means for receiving successive digital signals indicative of the amplitude of words of subsequent frames and for generating from the differential of amplitude values and the received digital signals the time scaled value at established time interpolation intervals for one of the words of one of the frames from the received digital signals;

adder means for receiving the digital words from said second means and for producing a digital signal corresponding to each frame and indicative of the sum of the time scaled signals corresponding to the words of each frame; and a digital-to-analog converter for receiving the output of said adder means and producing an analog signal corresponding to said first signal.

10. A synthesizer for converting consecutive frames of digital words into analog signals as set forth in claim 9 including a counter connected to said second means for establishing the time interpolation intervals between subsequent frames of digital words.

11. A synthesizer for converting consecutive frames of digital words into analog signals, said consecutive frames including frequency and amplitude information relating to consecutive, predetermined instants of time of a first signal, and one word of each frame comprising a channel containing fundamental frequency information bits relating to the fundamental frequency of the first signal at one instant of time, other consecutive words of each frame comprising channels containing amplitude information bits of consecutive, predetermined frequency bands of the first signal, said bands having a predetermined relation to the fundamental frequency of the first signal at one instant of time, said synthesizer including:

input means for receiving said consecutive frames of digital words;

first means connected to said input means and including a memory for storing digital signals indicative of the predetermined frequency and predetermined amplitude of the words of sequential frames, and means operatively associated with said memory for causing said memory to transmit successive digital signals indicative of the amplitude and frequency of words of subsequent frames;

second means connected to said first means and including arithmetic logic responsive to digital words in channels of successive frames to produce a difference digital signal therefrom, and means for receiving the difference digital signal and the frequency interpolation signal for generating a frequency scaled value for one of the words of one frame for the received digital signal; adder means for receiving the scaled value from said second means and for producing a digital signal corresponding to each frame and indicative of the sum of the frequency scaled signals corresponding to the words of each frame; and a digital-to-analog converter for receiving the output of said adder means for producing an analog signal corresponding to said first signal.

12. A synthesizer for converting consecutive frames of digital words into analog signals as set forth in claim 11 including means to generate digital signals indicative of a respective value of a trigonometric function as the frequency interpolation signal.

13. A synthesizer for converting consecutive frames of digital words into analog signals as set forth in claim 11 wherein said arithmetic logic includes means responsive to the product of the difference signal and the interpolation digital signal, and further responsive to a digital signal of one word of a frame to generate the frequency scaled signal.

14. A synthesizer for converting consecutive frames of digital words into analog signals as set forth in claim 11 wherein said second means includes means for storing digital signals representing the respective values of a trigonometric function, and means for addressing said means for storing to transfer stored digital signals to said means for receiving as the frequency interpolation signals.

15. A synthesizer for converting frames of digital words into analog signals as set forth in claim 14 including means responsive to the number of harmonic frequencies in a channel to generate a control signal to said means for addressing.

16. A synthesizer for converting consecutive frames of digital words into analog signals as set forth in claim 15 including means responsive to the channel number in a frame to generate a control signal to said means for addressing.

17. A synthesizer for converting consecutive frames of digital words into analog signals as set forth in claim 11 wherein said arithmetic logic unit includes control means for selecting the operation of said arithmetic logic to be responsive to digital words of successive frames to produce the difference digital signal in one mode of operation and to be responsive to the product of the difference signal and the interpolation signal and in the second mode also responsive to a digital signal of one frame word to generate a frequency scaled value.

18. A synthesizer for converting consecutive frames of digital words into analog signals as set forth in claim 17 including a buffer means for storing the product of the difference signal and the interpolation signal for subsequent processing to said arithmetic logic.

19. A synthesizer for converting consecutive frames of digital words into analog signals, said consecutive frames including frequency and amplitude information relating to consecutive, predetermined instants of time of a first signal, and one word of each frame comprising a channel containing fundamental frequency information bits relating to the fundamental frequency of the first signal at one instant of time, and other consecutive words of each frame comprising additional channels containing amplitude information bits of consecutive, predetermined frequency bands of the first signal, said bands having a predetermined relation to the fundamental frequency of the first signal at one instant of time, said synthesizer including:

input means for receiving said consecutive frames of digital words, first means connected to said input means and including storage elements in memory means for storing digital signals of three sequential frames each indicative of the predetermined frequency and predetermined amplitude of the words of the sequential frames, and control means for writing digital signals into selected storage elements from said input means and for reading digital signals from selected storage elements to transmit successive digital signals indicative of the amplitude and frequency of the words of subsequent frames;

second means connected to said first means and including arithmetic logic operative in a first mode to respond to digital words of successive frames to produce a difference signal therefrom, and means for receiving the difference signal and a frequency interpolation signal for generating an amplitude differential signal for one of the words of one frame, said arithmetic logic units responsive in a second mode to the amplitude differential signal and a digital signal of one frame to generate a frequency scaled value for one of the words of one frame, adder means for receiving the digital words from said second means and for producing a digital signal corresponding to each frame and indicative of the sum of the frequency scaled signals corresponding to words of each frame, and a digital-to-analog converter for receiving the output of said adder means and producing an analog signal corresponding to said first signal.

20. A synthesizer for converting consecutive frames of digital words into analog signals as set forth in claim 19 wherein said second means includes means for storing digital signals representing the respective points of a trigonometric function, and means for addressing said means for storing to transfer stored digital signals to said means for receiving as a frequency interpolation signal.

21. A synthesizer for converting consecutive frames of digital words into analog signals as set forth in claim 20 including means responsive to the number of harmonic frequencies in a channel to generate a control signal to said means for addressing.

22. A synthesizer for converting consecutive frames of digital words into analog signals as set forth in claim 21 including means responsive to the channel number of a frame to generate a control signal to said means for addressing.

23. A synthesizer for converting consecutive frames of digital words into analog signals, said consecutive frames including frequency and amplitude information relating to consecutive, predetermined instants of time of a first signal, and one word of each frame comprising a channel containing fundamental frequency information bits relating to the fundamental frequency of the first signal at one instant of time, and other consecutive words of each frame comprising channels containing amplitude information bits of consecutive, predetermined frequency bands of the first signal, said bands having a predetermined relation to the fundamental frequency of the first signal at one instant of time, said synthesizer including:

input means for receiving said consecutive frames of digital words, first means connected to said input means and including memory means for storing digital signals indicative of the predetermined frequency and predetermined amplitude of the words of sequential frames, and means operatively associated with said memory means for causing said memory means to transmit successive digital signals indicative of the amplitude and frequency of words of subsequent frames, second means connected to said first means and including storage means for the differential of amplitude signals of words at time interpolation intervals between subsequent frames, and means for receiving successive digital signals indicative of the amplitude and frequency of words of subsequent frames, and for generating a time scaled value for one of the words of one frame from the received digital signals, third means connected to said second means and including arithmetic logic responsive to the time scaled value for one of the words of successive frames to produce a difference digital signal therefrom, and means for receiving the difference digital signal and a frequency interpolation signal to generate a frequency scaled signal for one of the words of one frame, adder means for receiving the digital words from said third means and for producing a digital signal corresponding to each frame and indicative of the sum of the time and frequency scaled signals corresponding to the words of each frame, and a digital-to-analog converter for receiving the output of said adder means and producing an analog signal corresponding to said first signal.

24. A synthesizer for converting consecutive frames of digital words into analog signals as set forth in claim 23 wherein said memory means includes storage elements for three sequential frames of the frequency and amplitude words.

25. A synthesizer for converting consecutive frames of digital words into analog signals as set forth in claim 24 wherein said second means includes control means for reading digital signals from selected storage elements to said second means and for writing digital signals into selected storage elements from said input means.

26. A synthesizer for converting consecutive frames of digital words into analog signals as set forth in claim 23 wherein said storage means includes an array of logic memories, one memory for each time interpolation interval.

27. A synthesizer for converting consecutive frames of digital words into analog signals as set forth in claim 23 wherein said third means includes means for storing digital signals representing respective points on a trigonometric function, and means for addressing said means for storing to transfer stored digital signals to said means for receiving as the frequency interpolation signal.

28. A synthesizer for converting consecutive frames of digital words into analog signals as set forth in claim 27 including means responsive to the number of harmonic frequencies in a channel to generate a control signal to said means for addressing.

29. A synthesizer for converting consecutive frames of digital words into analog signals as set forth in claim 28 including means responsive to the channel number in a frame to generate a control signal to said means for addressing.

30. A synthesizer for converting consecutive frames of digital words into analog signals as set forth in claim 23 wherein said arithmetic logic includes control means for operating said logic in a first mode to be responsive to the time scaled signal and in a second mode responsive to an amplitude differential signal equal to the product of the difference signal and the time interpolation signal, and in said second mode also responsive to a digital signal of one frame word to generate the frequency scaled signal.

31. A synthesizer for converting consecutive frames of digital words into analog signals as set forth in claim 30 wherein said arithmetic logic operates in a first mode to produce the difference signal between amplitude values of words of the same number channel in subsequent frames and in a second mode generates the frequency scaled value by a summation of the amplitude difference signal and a digital signal of one frame word.

* * * * *